US006811297B2

(12) United States Patent
Oswald

(10) Patent No.: US 6,811,297 B2
(45) Date of Patent: Nov. 2, 2004

(54) VIBRATOR HAVING A CORE WITH SOFT SHEATH AND APERTURES THERETHROUGH

(76) Inventor: Fred Oswald, 27 Forest Dr., Sands Point, NY (US) 11050

( * ) Notice: Subject to any disclaimer, the term of this patent is extended or adjusted under 35 U.S.C. 154(b) by 149 days.

(21) Appl. No.: 10/083,716

(22) Filed: Feb. 25, 2002

(65) Prior Publication Data

US 2002/0131323 A1 Sep. 19, 2002

Related U.S. Application Data

(60) Provisional application No. 60/271,399, filed on Feb. 26, 2001.

(51) Int. Cl.[7] ..... B01F 11/00

(52) U.S. Cl. ..... 366/122; 366/123

(58) Field of Search ..... 366/108, 128, 366/120–123, 349

(56) References Cited

U.S. PATENT DOCUMENTS

| | | | | |
|---|---|---|---|---|
| 1,989,409 | A | 1/1935 | Gordon | |
| 2,073,393 | A | 3/1937 | Mall | |
| 2,078,477 | A | 4/1937 | Whiting | |
| 2,080,727 | A | 5/1937 | Ludeman, Jr. | |
| RE21,684 | E | 1/1941 | Mall | |
| 2,232,842 | A | 2/1941 | Douglass | |
| 2,492,431 | A | * 12/1949 | Kroeckel | 366/122 |
| 2,597,505 | A | 5/1952 | Lindkvist | |
| 2,603,459 | A | 7/1952 | McCrery | |
| 2,705,618 | A | 4/1955 | Wyzenbeek | |
| 2,800,309 | A | 7/1957 | Giertz-Hedstrom | |
| 3,042,386 | A | 7/1962 | Wyzenbeek | |
| D200,012 | S | 1/1965 | Whitman | |
| 3,202,402 | A | 8/1965 | Giertz-Hedstrom | |
| 3,357,267 | A | 12/1967 | Halilovic et al. | |
| 3,836,124 | A | 9/1974 | Malan | |
| 3,961,774 | A | 6/1976 | Strohbeck et al. | |
| 4,812,327 | A | 3/1989 | Hanazawa et al. | |
| 5,108,189 | A | 4/1992 | Oswald | 366/123 |
| 5,556,199 | A | 9/1996 | Oswald | 366/120 |
| 6,155,708 | A | 12/2000 | Lindley | 366/123 |
| D456,034 | S | 4/2002 | Oswald | |
| 2002/0131323 | A1 * | 9/2002 | Oswald | 366/122 |
| 2003/0111753 | A1 * | 6/2003 | Oswald et al. | 264/35 |

FOREIGN PATENT DOCUMENTS

| | | |
|---|---|---|
| BE | 428033 | 5/1938 |
| DE | 1946419 | 4/1971 |
| EP | 0532793 A1 * | 3/1993 |
| GB | 699580 | 11/1953 |
| GB | 979469 | 1/1965 |

OTHER PUBLICATIONS

OZTEC Advertising flyer published on or about 1997; first sold to the public in Jun. 1995.
WYCO Product brochure published on or about Mar. 2001.
WYCO Advertising flyer published on or about Feb. 2001.

* cited by examiner

*Primary Examiner*—Charles E. Cooley
(74) *Attorney, Agent, or Firm*—Ladas & Parry

(57) ABSTRACT

A vibrator having a metallic cylindrical core with a shaft extending concentrically therethrough. An eccentric weight is mounted on the shaft and is rotatable thereby to vibrate said vibrator. The core is surrounded by a sheath of material and apertures extend through said sheath to bare portions of said core. The external surface of the sheath is configured to present upstanding wall portions facing the direction of vibration whereby, when the vibrator is immersed in a wet slurry of concrete and vibrated therein, the upstanding wall portions drive shockwaves into the slurry.

37 Claims, 11 Drawing Sheets

VIBRATOR HAVING A CORE WITH SOFT SHEATH AND APERTURES THERETHROUGH

CROSS REFERENCE TO PROVISIONAL APPLICATION

This application claims priority of U.S. Provisional Application No. 60/271,399 filed Feb. 26, 2001. The whole content, including drawings, of that provisional application is incorporated by reference.

BACKGROUND OF INVENTION

In the construction industry, it is frequently necessary to lay a large area of concrete. Such areas can include, for example, foundations for buildings, floors, driveways, sidewalks, ramps, etc. Concrete exhibits characteristics of strength in compression but is poor in tension. To increase strength in tension, it is common practice to prepare a grid of reinforcing bars and then to pour concrete over and around the grid whereby the reinforcing bars improve the strength of the poured concrete.

Although the quality of the concrete improves with the dryness of the mix, it is nevertheless axiomatic that pourable concrete is wet in nature. Concrete is a mixture of cement, sand and stones. Lime is an ingredient in cement and water is added to the mixture to form a mix or slurry. The water activates the lime and an insufficient amount of water will not activate the lime. Consequently, the reinforcing bars in the grid are surrounded with a wet product and, if unprotected, the bars will rust. While moisture alone will create an environment which is conducive to rust, the problem is exacerbated in situations where water becomes contaminated with salt(s). Such conditions can occur, for example, when roads are spread with salt in wintertime or when the concrete is poured in an oceanfront community.

When a steel bar rusts it expands, and it will be appreciated that expansion of the bar within the concrete will cause the set concrete to crack.

To overcome this problem, it has been practice in the art to envelop the reinforcing bars in a plastic-like coating, most commonly an epoxy, which will protect the bar from wet liquid and hence avoid rusting and the subsequent detrimental consequences thereof.

After the wet concrete has been poured over and around the grid of reinforcing bars, it is common practice in the art to vibrate the concrete to remove air and voids from the poured mix. In this manner, when the concrete hardens, the slab will be more compact and undesirable pockets within the hardened concrete are avoided and the integrity of the concrete is not compromised.

Concrete vibrators take the form of a metal cylinder with a rotator inside which causes the metal cylinder to vibrate. The rotator is mounted on one end of a flexible drive cable and the vibrating cylinder is introduced into, and immersed in, the wet concrete mix and generates vibrations therewithin. Such vibrations may be of a frequency of 10,000 vibrations per minute and an immediate problem arises in that such a rapidly vibrating metal cylinder will chip the plastic covering of the reinforcing bars, thereby exposing the metallic bars to the wet concrete and creating the potential for the destructive rust condition as described above.

To minimize this problem, advanced vibrator heads have been provided in which the metal cylinder is encased within a sleeve or sheath of robust but softer material. Such sheathed vibrators are commonly referred to as "rubberheads". The advantage is immediately apparent in that, although the exterior of a rubberhead vibrates at the same frequency as the enclosed steel core, the relative"softness" of the sheath is less likely to chip the plastic coating of the reinforcing bars.

Although achieving the foregoing advantage of minimizing destruction as reinforcing bars, sheathed vibrators ("rubberheads") create a disadvantage in that the steel core of the vibrator gets hot when vibrating at operating frequencies. With an unsheathed metal vibrator ("steelhead") the heat generated can easily be dissipated in the wet concrete slurry. However, when the steel core is sheathed in the manner of a rubberhead, it is necessary to make provision for conducting heat away during operation. For this purpose, it is known to provide apertures or openings in the surrounding sheath which expose the inner metallic core and enable the wet concrete slurry to contact the core and conduct away the heat. If no such apertures or openings are provided, then a rubber coating completely encompassing and concealing the vibrating metallic core would serve as an insulating surface and would retain heat.

U.S. Pat. No. 5,556,199, owned by the applicant of this application, describes a rubberhead and the entire content of that earlier patent is incorporated herein by reference.

The present invention realizes that such apertures or openings passing through the sheath additionally function as suction cups in a rapidly vibrating vibrator and thereby hold wet concrete tight against the vibrating metallic core. The retention of concrete within the pockets by means of suction will cause the concrete to vibrate and thereby enhance the removal of air and elimination of pockets.

Although the suction cup effect of the apertures enhances vibration, the present invention greatly increases vibration by configuring the sheath to amplify the shockwaves transmitted into the wet concrete by the vibrating vibrator.

In prior vibrators, the cooling apertures or pockets in the sheath have been either straight-sided or flared outwardly from the surface of the metallic core to the outer surface of the sheath. With each of these configurations of the cooling apertures the apertures open into a relatively smooth surface portion of the sheath.

SUMMARY OF INVENTION

One embodiment of a vibrator of the present invention is cylindrical with a conical leading end and a tapered rearward end. A cylindrical steel core housing a vibrating mechanism is surrounded by a sheath of material which is softer than the metallic core. A plurality of apertures extend through the shaft to expose portions of the metallic core. The apertures are elongated and groups of apertures are disposed around the periphery of the sheath with the elongated apertures in each group having their longitudinal axes aligned with the longitudinal axis of the vibrator.

In order to increase the shockwaves imparted by the vibrating vibrator, the present invention configures the external sheath so that there are upstanding wall portions, at least around the apertures, which serve to "drive" the shockwaves into the concrete surrounding the vibrator.

In order to provide an upstanding wall portion at the location of each cooling aperture, the configuration of the sheath is such that the leading side (in the direction of oscillation) of each elongated aperture is cut away in such manner that the cut away portion reduces the height of said leading side of the aperture. The cut away portion may lead directly to the steel core or there may be a step down from the level at which the cut away portion enters the aperture down to the steel core. With this configuration, the opposite or trailing side of the aperture is exposed and presents an upstanding wall portion which serves to "drive" shockwaves into the concrete.

In addition to exposing the trailing side of the apertures in the manner described in the preceding paragraph, longitudinal recesses may be provided in the surface of the sleeve similarly to present an upstanding wall portions facing the direction of vibration.

DESCRIPTION OF THE DRAWINGS

The invention will now be more particularly described with reference to the accompanying drawings in which.

Before describing preferred embodiments of the invention with reference to the drawings, it is again observed that this application claims priority from Provisional Application No. 60/271,399. That provisional application included twenty eight figures of drawings all of which are incorporated herein by reference.

DESCRIPTION OF PREFERRED EMBODIMENTS

Figure 1:
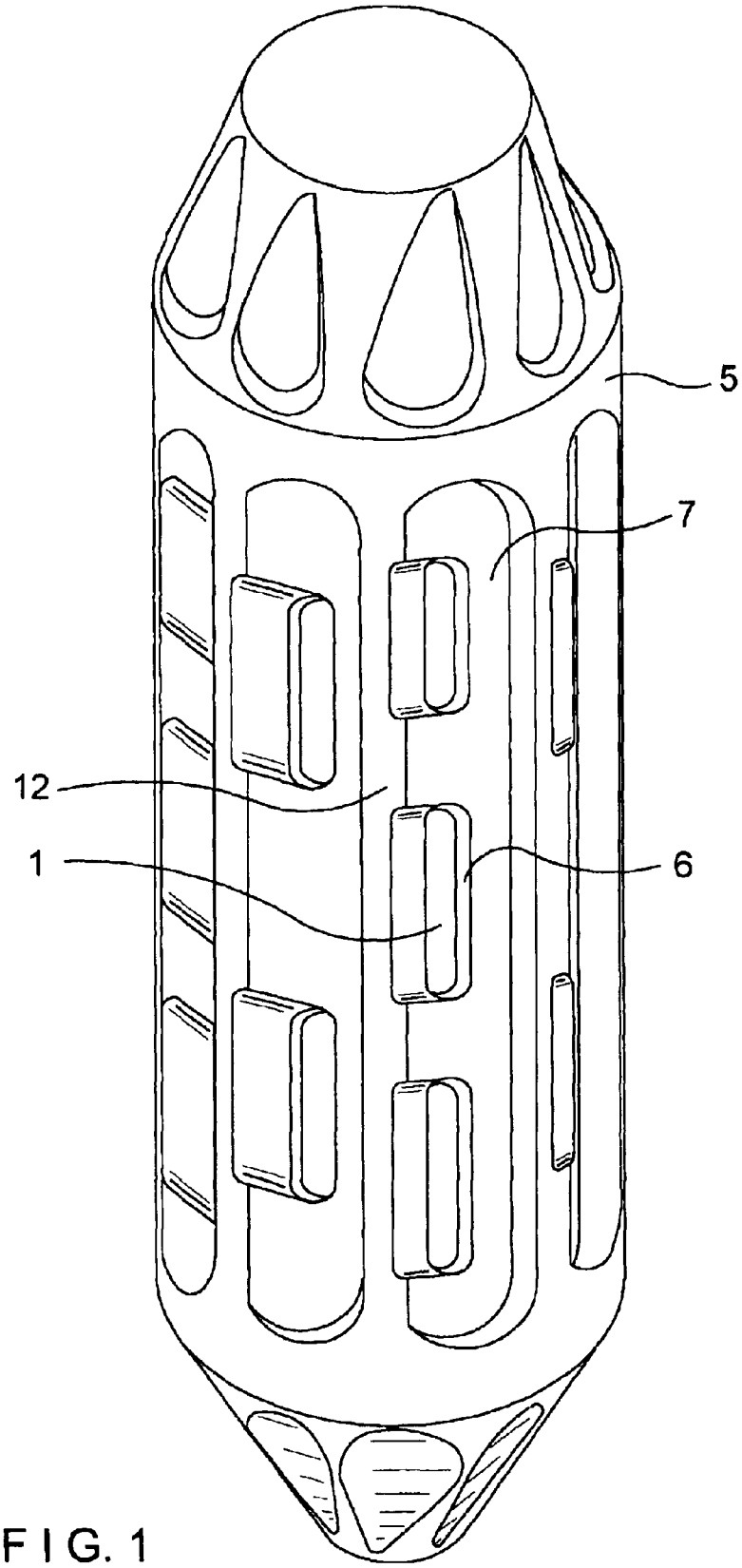
FIG. 1 is a perspective view of a first embodiment of a vibrator head of the invention.
Figure 4:
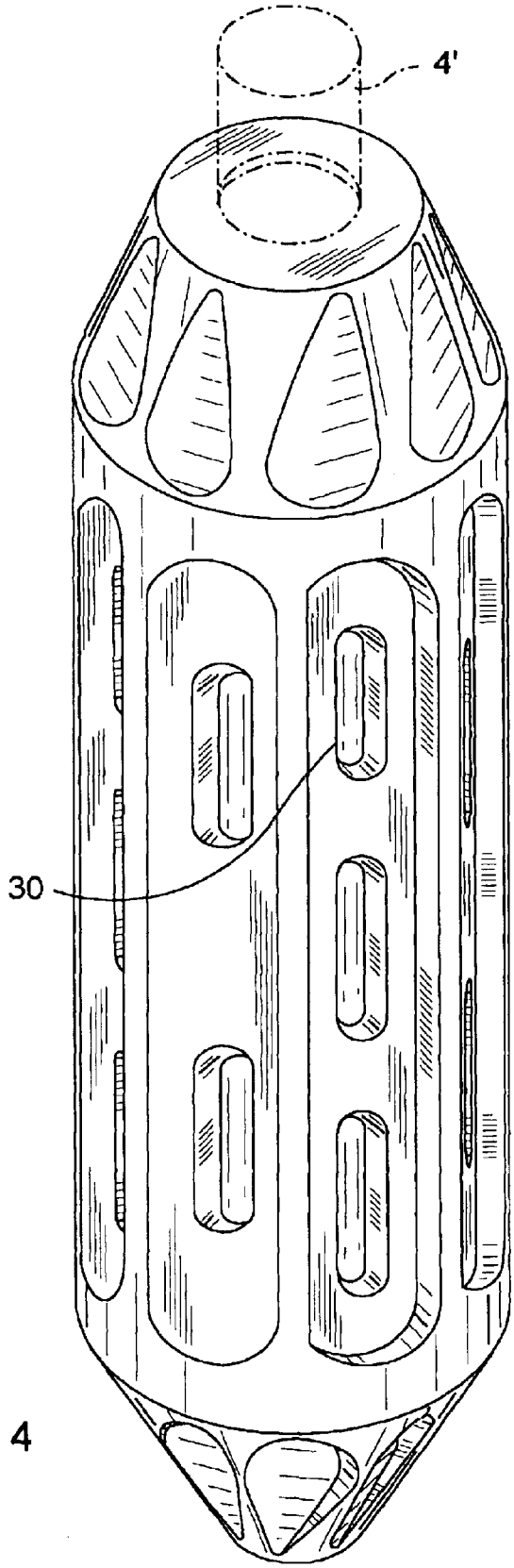
FIG. 4 is a perspective view of a second embodiment of the invention.
Figure 5:
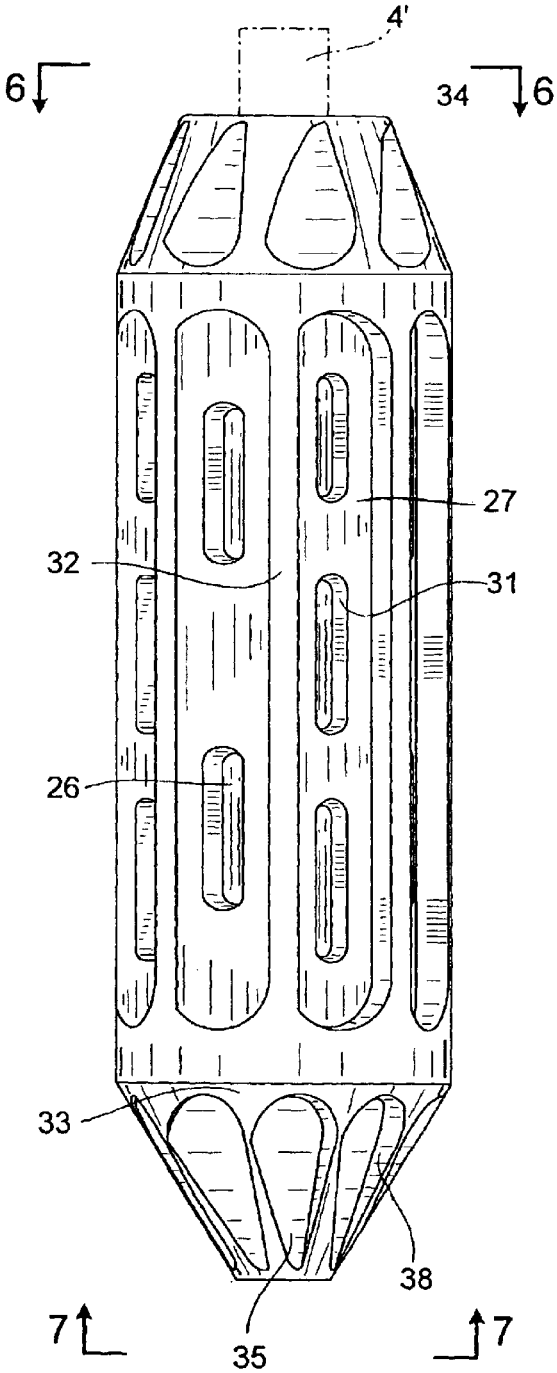
FIG. 5 is a side elevation of the embodiment of FIG. 4.
Figure 6:
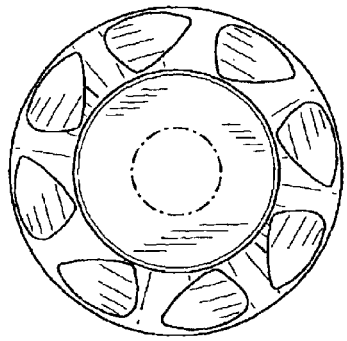
FIG. 6 is a top view of FIG. 5.
Figure 7:
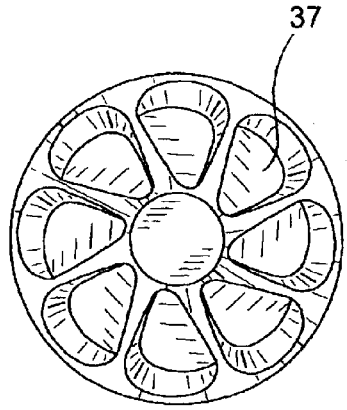
FIG. 7 is a bottom view of FIG. 5.

FIG. 1 of the drawings shows a first embodiment of a vibrator of the invention. As explained, the vibrator includes a metal cylinder 1 through which a concentric shaft 2 extends. An eccentric weight 3 is secured on the shaft for rotation thereby. Rotation of the shaft 2 with the concentric weight 3 causes the cylinder to vibrate. The shaft 2 is coupled to external drive source by a cable not shown in FIG. 1 but schematically designated by reference numeral 4 in FIG. 2 and 4' in FIG. 4 of the drawings. The cable 4,4' is coupled to the shaft 2 by conventional means and the eccentric weight 3 may be welded to or keyed on the shaft 2, again in accordance with conventional practice.

The metal cylinder 1 is completely surrounded by a sheath 5 of robust, but relatively soft material. The sheath is rubber-like in consistency and hence gives name to the term "rubberhead".

As explained in the opening paragraphs of the specification, vibration of the metal cylinder by rotation of the eccentric weight mounted on the shaft generates a substantial amount of heat and, in order to dissipate this heat, apertures 6 extend through the sheath 5 to expose portions of the underlying cylinder 1. In this manner, when the vibrator head is immersed in a wet slurry, wet slurry will contact the cylinder through the apertures and assert a cooling effect.

In use, the rapidly vibrating head agitates slurry to remove pockets and voids and enhance setting of the poured concrete. Agitation is effectively increased by transmitting shockwaves into the wet concrete mix from the vibrator. To this end, the external surface of the sheath 5 is configured to drive shockwaves into wet concrete by the vibrating vibrator.

Figure 2:
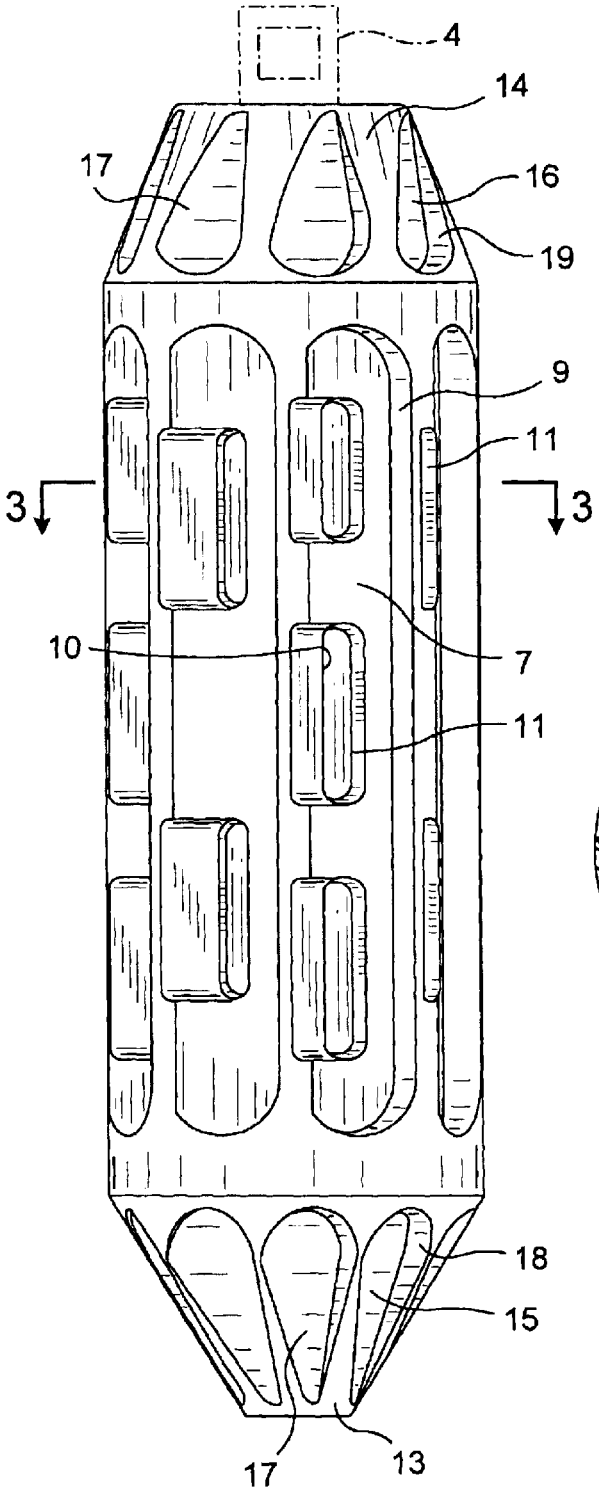
FIG. 2 is a side elevation of the embodiment to FIG. 1.
Figure 3:
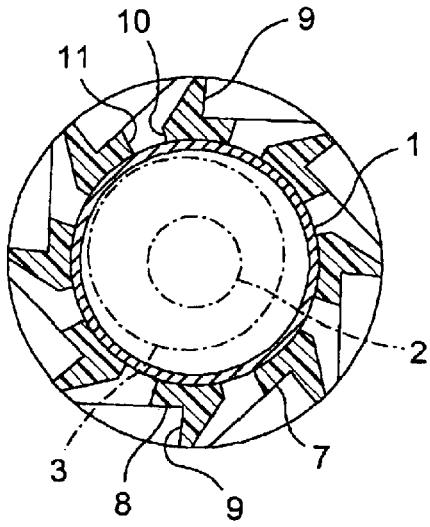
FIG. 3 is a section along the line III—III of FIG. 1.

Referring specifically to the embodiment shown in FIGS. 1 to 3 of the drawings, the sheath 5 extends around and encompasses the cylinder 1. Elongated recesses 7 are cut into the sheath external surface with the bottoms 8 of the recesses 7 lying on chord planes around the external surface of the sheath. In this manner, each recess bottom 8 terminates at the foot of an upstanding wall portion 9, with each wall portion extending longitudinally at least part way along the length of the sheath. These upstanding wall portions will serve to "drive" shockwaves outwardly of the sheath when the latter is vibrated by the shaft and eccentric weight. Similar upstanding wall portions extend along one longitudinal edge of the apertures 6 in the manner now to be described.

Still referring to FIGS. 1 to 3 of the drawings, each aperture 6 is an elongated slot extending from the external surface of the sheath through to the metal cylinder to expose a portion of that cylinder. Each aperture 6 opens into the bottom of an elongated recess and with the vibrator head vibrating in an anti-clockwise orbital motion, each aperture can be said to have leading side edge 10 and a trailing side edge 11. The trailing side edge 11 extends upwardly, substantially perpendicularly, from the aperture bottom to the bottom 8 of the elongated recess 7. The leading edge 10 is cut away, again in the plane of a chord, to open into the sheath surface at a region intermediate into elongated recesses. A plurality of apertures 6 are provided in each recess 7 and, in the embodiment shown in FIGS. 1 to 3, some recesses accommodate three apertures while other recesses accommodate two apertures. The regions intermediate the recesses 7 are lands designed by reference numeral 12 in FIG. 1 of the drawings. In this manner, as viewed along a chord plane, the cut away leading edges of the recesses expose the trailing edges which, like the wall portions 9 of the elongated recesses 7, stand proud and serve to enhance the transmission of shockwaves into the wet concrete slurry surrounding the vibrator head in use.

As shown most clearly in FIGS. 1 and 2, the vibrator head is of overall cylindrical appearance with tapered leading and trailing end portions. The leading end portion 13 is frustoconical in shape and the trailing end portion 14 is similarly configured and receives the cable 4 which serves to vibrate the shaft 2.

Plurality of tear-shaped recesses 15,16 are provided respectively in the leading and trailing end portions 13,14. Each tear-shaped recess has a floor 17 which, similarly to the recesses 7, lies on a chord plane and the leading edge in the direction of oscillatory vibration opens smoothly into the surface of the frusto-conical end portion. With this configuration, the trailing edge of the tear-shaped recess provides an upstanding wall portion 18,19 which compliments the upstanding wall portions 9,11 of the elongated recesses 7 and apertures 6 further to enhance the driving of shockwaves into the concrete slurry in use.

In the embodiment shown in FIGS. 4 to 7 of the drawings, a vibrator head is similarly generally cylindrical in form with tapered frusto-conical leading and trailing end portions 33,34. Elongated recesses 27 extend longitudinally part way along the cylindrical portion and apertures 26 are formed wholly within those recesses. Thus, unlike the embodiment of FIGS. 1 to 3, the leading side edges 30 of the apertures 26 do not extend into the regions 32 between the recesses 27 and hence the apertures 6 present less prominent trailing side edges 31. Moreover, only the leading end portion 33 has tear-shaped recesses 35 with floor portions 37 which merge smoothly into the surface of the frusto-conical leading end portion to present prominently upstanding wall portions 38 to enhance driving shockwaves. The corresponding portions on the trailing end portion are generally plane in configuration.

Figure 8:
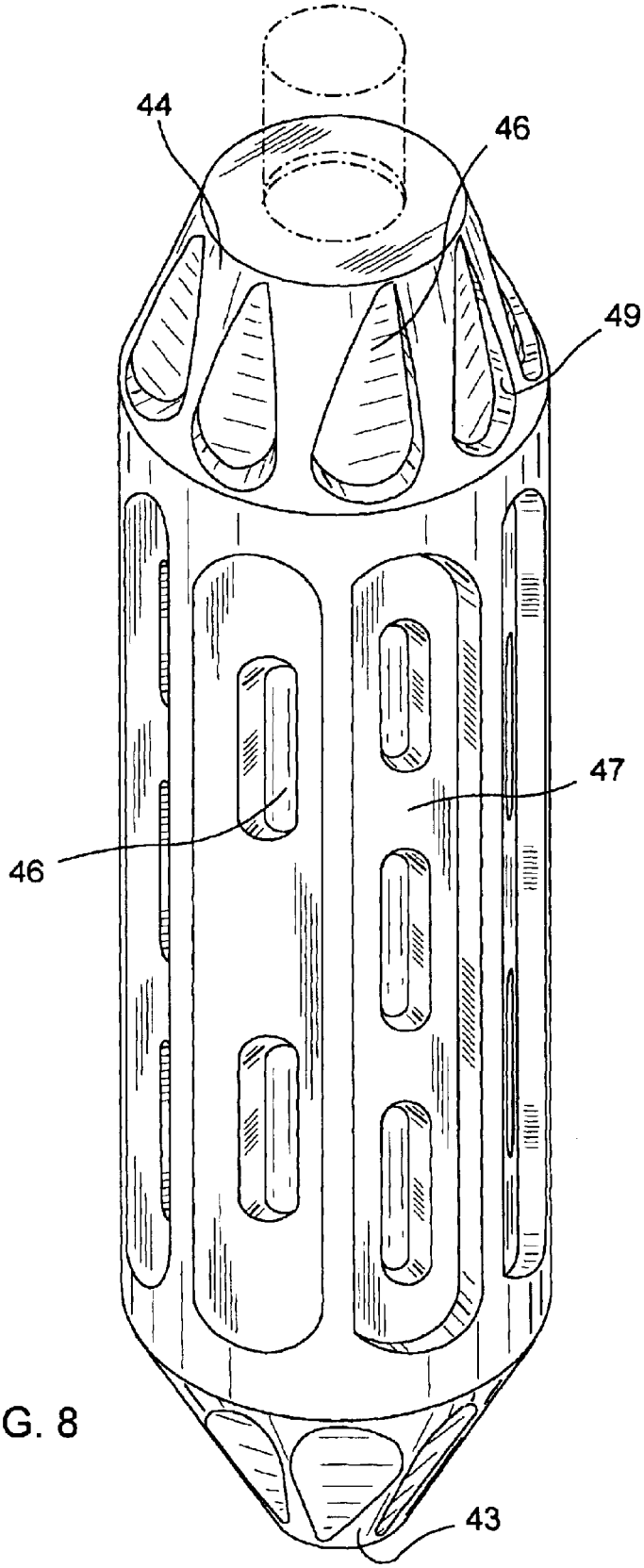
FIG. 8 is a perspective view of a further embodiment of the invention.
Figure 9:
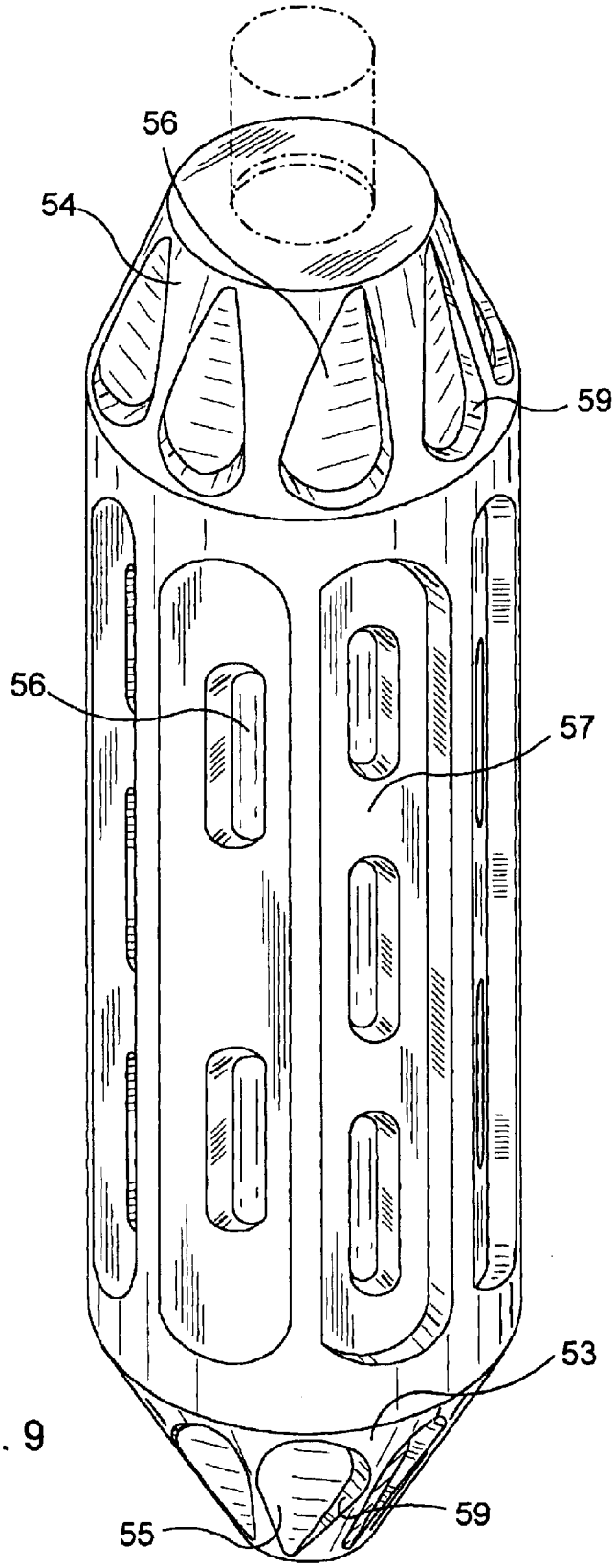
FIG. 9 is a perspective view of a still further embodiment of the invention.
Figure 10:
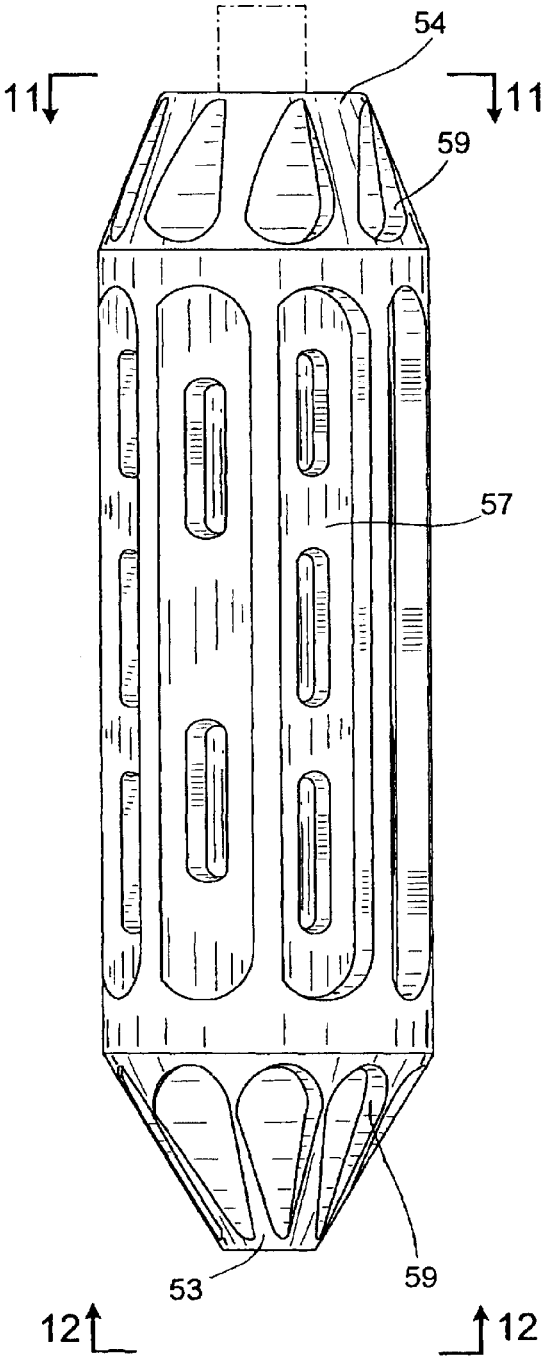
FIG. 10 is an elevation of the embodiment shown in FIG. 9.
Figure 11:
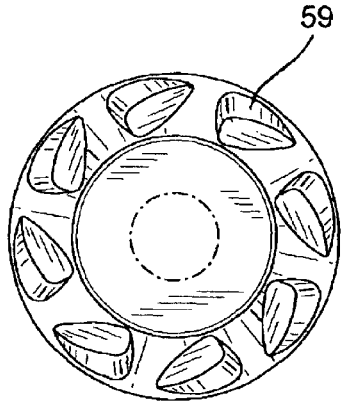
FIG. 11 is a top view of FIG. 10.
Figure 12:
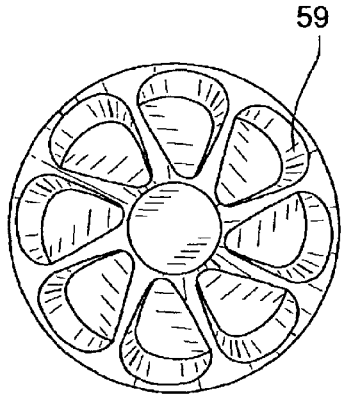
FIG. 12 is a bottom view of FIG. 10.
Figure 13:
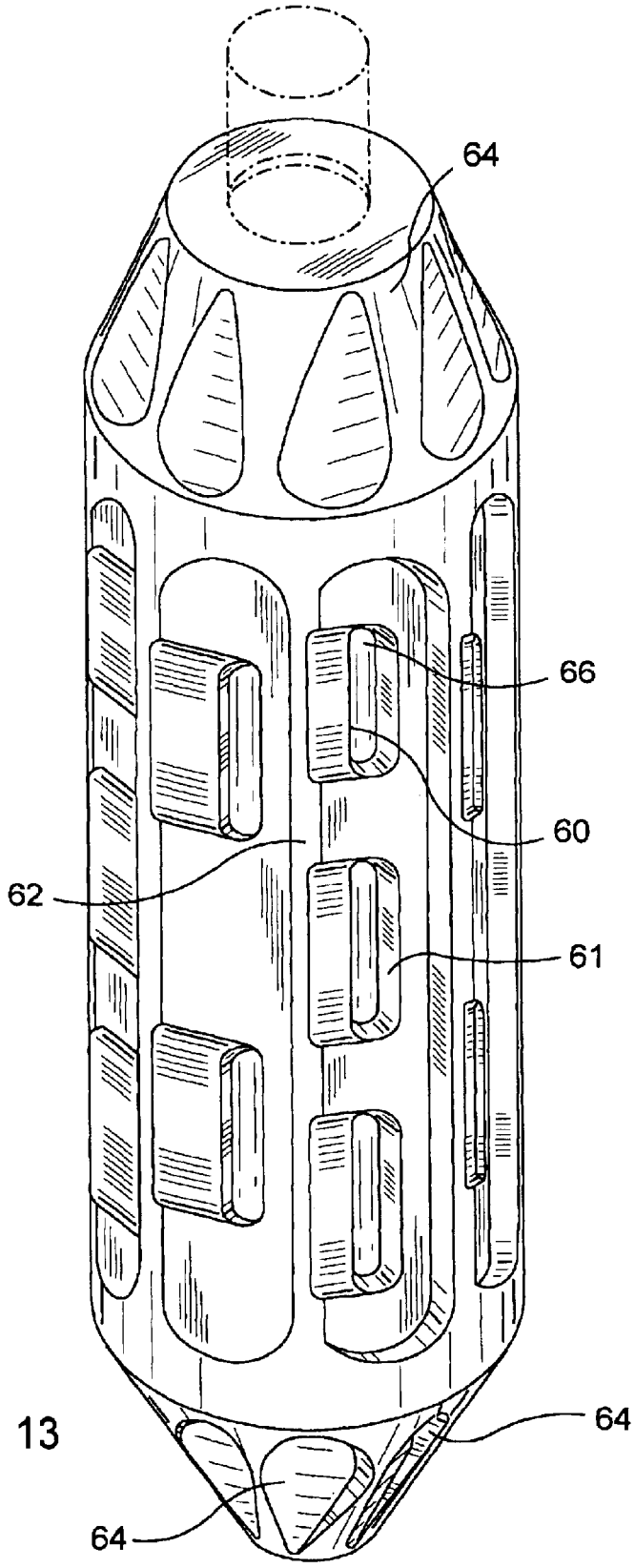
FIG. 13 is a perspective view of a further embodiment of the invention.
Figure 14:
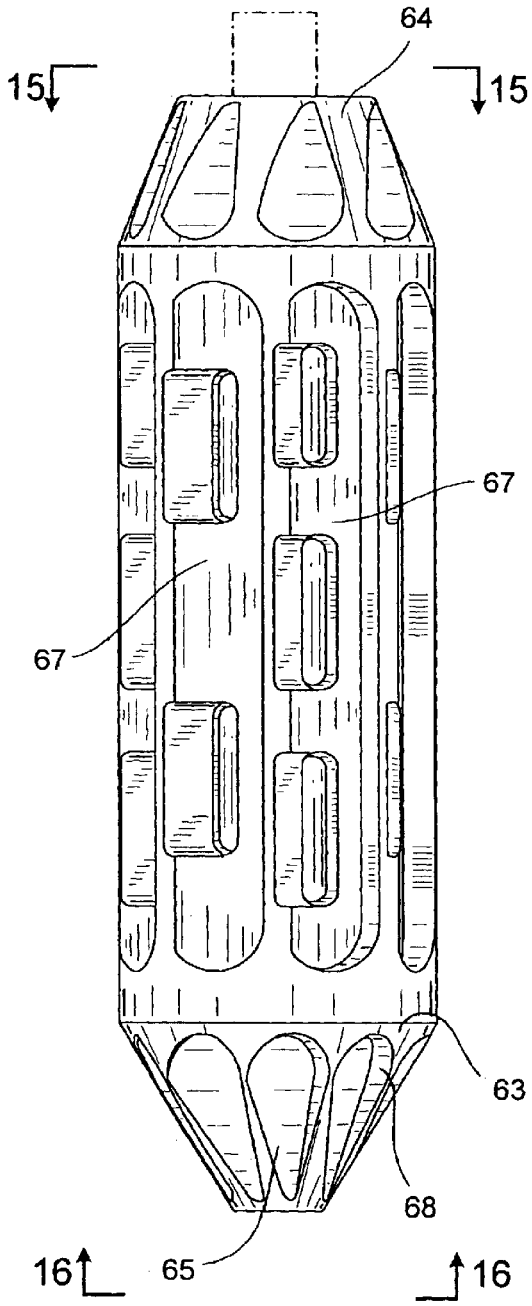
FIG. 14 is a side elevation of the embodiment shown in FIG. 13.
Figure 15:
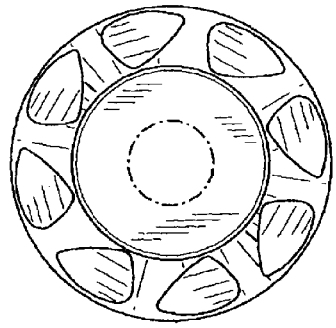
FIG. 15 is a top view of FIG. 14.
Figure 16:
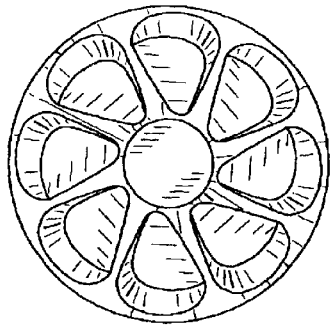
FIG. 16 is a bottom view of FIG. 14.
Figure 17:
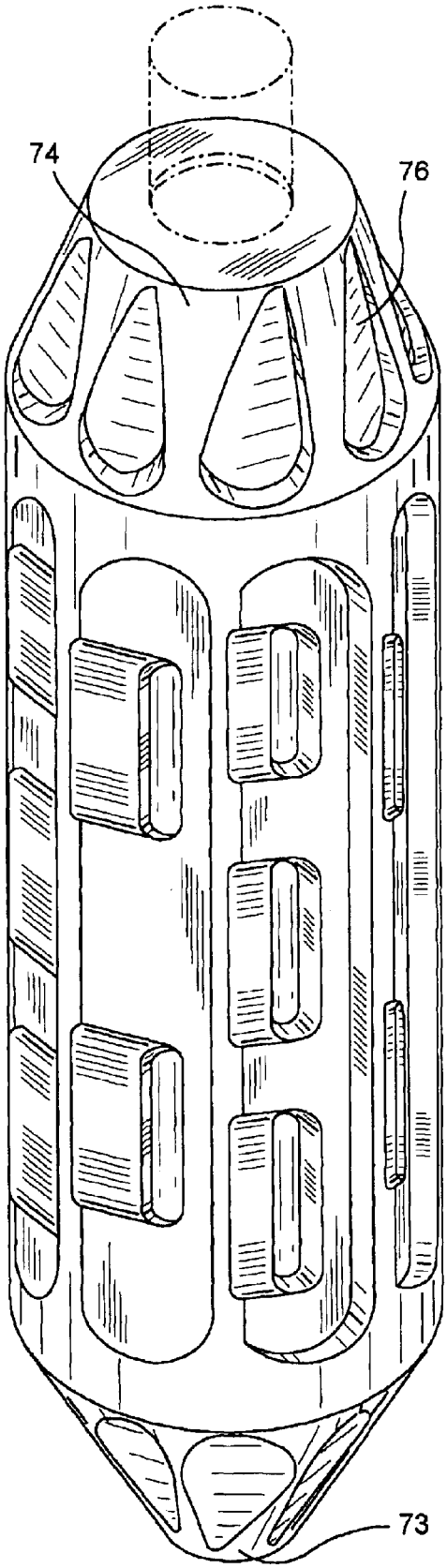
FIG. 17 is a perspective view of a further embodiment of the invention.
Figure 18:
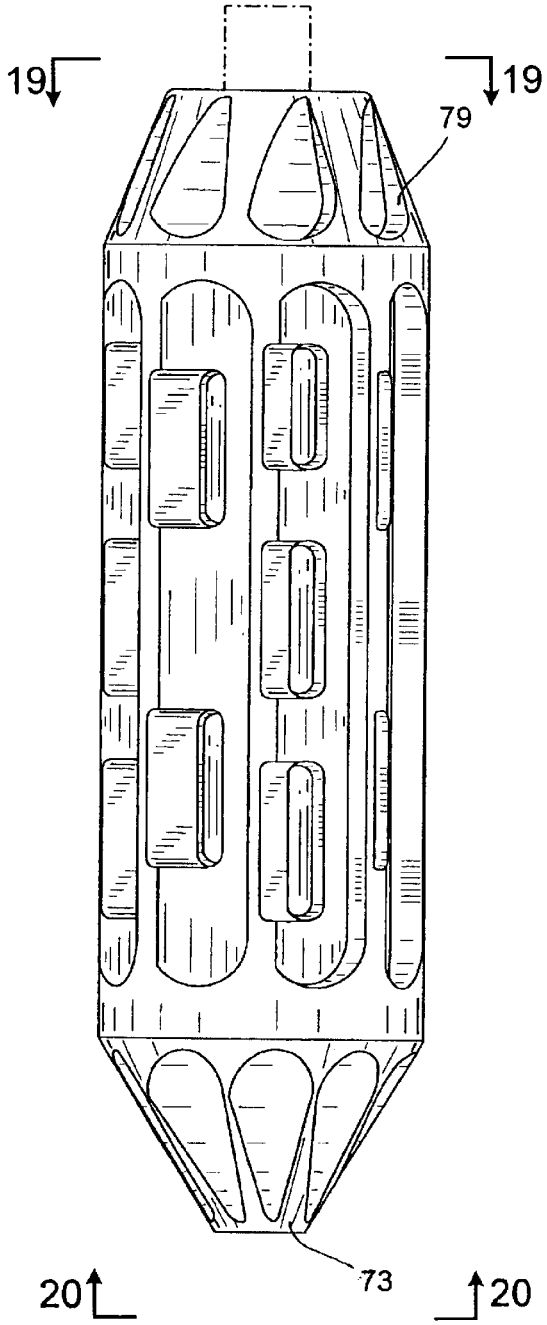
FIG. 18 is a side elevation view of the embodiment of FIG. 17.
Figure 19:
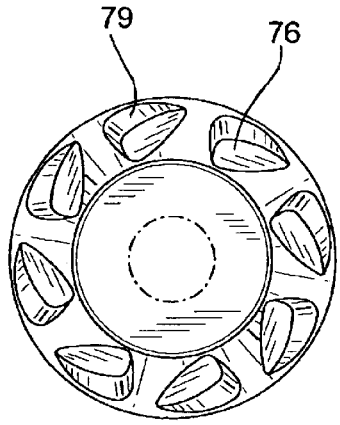
FIG. 19 is a top view of FIG. 18.
Figure 20:
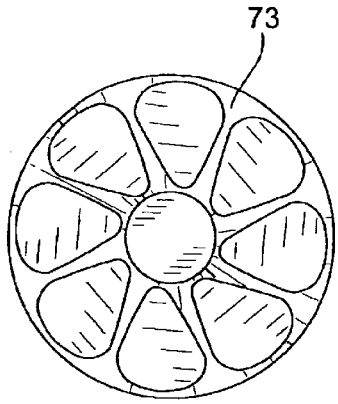
FIG. 20 is a bottom view of FIG. 18.

Further alternative arrangements are shown in the embodiments of FIGS. 8–12. In the embodiment of FIG. 8, tear-shaped recesses 46 presenting upstanding wall portions 49 are provided in the trailing end portion whereas generally plane portions are provided in the leading end portion 43. In the embodiment of FIGS. 9–12 upstanding wall portions 58,59 are provided in tear-shaped recesses 55,56 in the respective leading and trailing edges 53 and 54. In both the FIG. 8 and FIGS. 9–12 embodiments the apertures 46,56 are wholly within the elongated recesses 47 and 57.

Turning now to the embodiment of FIGS. 13 to 16, this embodiment is similar to the embodiment described with reference to FIGS. 1 to 3 with the exception that tear-shaped recesses 65 are provided in the leading end portion 63 to present upstanding wall portions 68 whereas generally plane portions are provided in the trailing end portion 64. In this embodiment the leading side edges 60 of the apertures 66 are cut away to merge with the regions 62 between elongated recesses 67 to present prominently upstanding trailing side edges 61 of which, together with the upstanding wall portions 68 of the leading end portion 63 serve to drive shockwaves into the concrete in use. The opposite arrangement is shown in the embodiment of FIGS. 17 to 20 where tear-shaped recesses 76 are provided in the frusto-conical trailing end portion 74 to present upstanding shockwave driving wall portions 79 whereas generally plane portions are provided on the frusto-conical leading end portion 73.

In all the foregoing described embodiments, at least some portions of the sheath are configured to provide upstanding wall portions which face in the direction of oscillatory vibration in use and serve to drive agitating shockwaves in the concrete. It will be appreciated that other combinations of apertures/longitudinal recesses, leading and trailing end portions can be provided but all with the object of providing enhanced shockwave transmission.

What is claimed is:

1. A vibrator having a vibratable core and a sheath of relatively soft material, said sheath having a plurality of apertures formed therein and extending from the external surface thereof through to the core, and said sheath further having projecting portions upstanding from said external surface and facing in the direction of vibration.

2. A vibrator as claimed in claim 1, wherein at least some of said apertures are elongated with lengthwise leading and trailing edges aligned with the longitudinal axis of said vibrator, and wherein said trailing edges are exposed to provide wall portions facing in the direction of vibration.

3. A vibrator as claimed in claim 2, wherein the leading edges of said at least some apertures are cut away to merge into the external surface of the vibrator.

4. A vibrator as claimed in claim 3, wherein the cut away leading edges of the apertures merge with the external surface of the vibrator at a chord angle.

5. A vibrator as claimed in claim 2, wherein said vibrator is generally cylindrical in shape and the apertures are arranged in groups around the cylindrical periphery with apertures in each group longitudinally aligned in the axial direction of said vibrator.

6. A vibrator as claimed in claim 1, wherein said vibrator has a leading end portion, a trailing end portion and a generally cylindrical body portion intermediate said leading and trailing end portions, wherein elongated recesses extend lengthwise at least partly along said cylindrical body portion, each said elongated recess having a leading edge and a trailing edge, and wherein said leading edges are cut away to merge with the cylindrical body and thereby expose said trailing edges which present upstanding wall portions facing in the direction of vibration.

7. A vibrator as claimed in claim 6, wherein the apertures are located in the recesses.

8. A vibrator as claimed in claim 7, wherein a plurality of apertures are located in each recess with the apertures in each recess aligned in the longitudinal direction of the cylindrical body portion.

9. A vibrator as claimed in claim 7, wherein said apertures are elongated with lengthwise leading and trailing edges and wherein said leading edges of said apertures are cut away along a chord plane to merge with the vibrator cylindrical body at locations in the lands between adjacent recesses.

10. A vibrator as claimed in claim 6, wherein the leading end portion of the vibrator is frusto-conical in shape and the trailing end portion is also frusto-conical in shape and wherein elongated recesses are formed lengthwise in at least one of said leading and trailing end portions.

11. A vibrator as claimed in claim 10, wherein elongated recesses are formed lengthwise in both said leading and trailing end portions.

12. A vibrator as claimed in claim 10, wherein the elongated recesses in at least one of said leading and trailing end portions are tear-shaped and wherein the forward side edge of each tear-shaped recess in the direction of vibration is cut back to merge with the frusto-conical body portion to expose the opposed rearward side edge which thereby presents an upstanding wall portion facing in the direction of vibration.

13. A vibrator as claimed in claim 1, wherein the vibratable core is a metal cylinder having a rotatable shaft extending concentrically therein, and wherein an eccentric weight is rotatable by said shaft to impart oscillatory vibrations to said vibrator.

14. A vibrator having a vibratable core surrounded by a sheath of relatively soft material, said sheath having a plurality of apertures extending therethrough to expose portions of said core, wherein the sheath has a leading end portion, a trailing end portion end an elongated intermediate section, and wherein at least one recess is formed in the external surface of said intermediate section and extends longitudinally therein, said at least one recess having a leading said edge and a trailing side edge with said trailing side edge being exposed to present a wall portion facing in the direction of vibration.

15. A vibrator as claimed in claim 14, wherein a plurality of recesses extend longitudinally at least partly along the external surface of the intermediate section and wherein the apertures are located in the recesses.

16. A vibrator as claimed in claim 15, wherein a plurality of apertures are located in each recess, at least some of said apertures being elongated with lengthwise leading and trailing edges aligned with the longitudinal axis of said vibrator, said trailing edges of said apertures being exposed to provide wall portions facing in the direction of vibration, and wherein the apertures in each recess are aligned in the longitudinal direction of the cylindrical body portion.

17. A vibrator as claimed in claim 15, wherein said apertures are elongated with lengthwise leading and trailing edges and wherein said leading edges of said apertures are cut away along a chord plane to merge with the vibrator cylindrical body at locations in the lands between adjacent recesses.

18. A vibrator as claimed in claim 14, wherein the leading end portion of the vibrator is frusto-conical in shape and the trailing end portion is also frusto-conical in shape and wherein elongated recesses are formed lengthwise in at least one of said leading and trailing end portions.

19. A vibrator as claimed in claim 18, wherein elongated recesses are formed lengthwise in both said leading and trailing end portions.

20. A vibrator as claimed in claim 18, wherein the elongated recesses in at least one of said leading and trailing end portions are tear-shaped and wherein the forward side edge of each tear-shaped recess in the direction of vibration is cut back to merge with the frusto-conical body portion to expose the opposed rearward side edge which thereby presents an upstanding wall portion facing in the direction of vibration.

21. A vibrator having an elongated vibratable core surrounded by a sheath of relatively soft material, said sheath having a plurality of apertures extending therethrough to expose portions of said core, wherein at least one of said apertures is elongated and has a lengthwise axis lying substantially parallel to the longitudinal axis of said vibrator, and wherein said at least one aperture has a leading side edge and a trailing side edge with respect to the direction of vibration, said trailing edge being of greater height than said leading edge to present an upstanding wall portion.

22. A vibrator as claimed in claim 21, wherein the leading edge of said at least one aperture is cut away to merge into the external surface of the vibrator.

23. A vibrator as claimed in claim 22, herein the cut away leading edge of the aperture merges with the external surface of the vibrator at a chord angle.

24. A vibrator as claimed in claim 21, wherein said vibrator is generally cylindrical in shape and a plurality of apertures are arranged in groups around the cylindrical periphery with apertures in each group longitudinally aligned in the axial direction of said vibrator.

25. A vibrator as claimed in claimed 21, wherein said vibrator has a leading end portion, a trailing end portion and a generally cylindrical body portion intermediate said leading and trailing end portions, wherein elongated recesses extend lengthwise at least partly along said cylindrical body portion, each said elongated recess having a leading edge and a trailing edge, and wherein said leading edges are cut away to merge with the cylindrical body and thereby expose said trailing edges which present upstanding wall portions facing in the direction of vibration.

26. A vibrator as claimed in claim 25, wherein the apertures are located in the recesses.

27. A vibrator as claimed in claim 26, wherein a plurality of apertures are located in each recess with the apertures in each recess aligned in the longitudinal direction of the cylindrical body portion.

28. A vibrator as claimed in claim 26, wherein said leading edges of said apertures are cut away along a chord plane to merge with the vibrator cylindrical body at locations in the lands between adjacent recesses.

29. A vibrator as claimed in claim 25, wherein the leading end portion of the vibrator is frusto-conical in shape and the trailing end portion is also frusto-conical in shape and wherein elongated recesses are formed lengthwise in at least one of said leading and trailing end portions.

30. A vibrator as claimed in claim 29, wherein elongated recesses are formed lengthwise in both said leading and trailing end portions.

31. A vibrator as claimed in claim 29, wherein the elongated recesses in at least one of said leading and trailing end portions are tear-shaped and wherein the forward side edge of each tear-shaped recess in the direction of vibration is cut back to merge with the frusto-conical body portion to expose the opposed rearward side edge which thereby presents an upstanding wall portion facing in the direction of vibration.

32. A vibrator having an elongated core vibratable with an oscillatory motion, a sheath surrounding said core and having a frusto-conical leading end portion, a frusto-conical trailing end portion and an elongated generally cylindrical portion intermediate said leading and end portions, a plurality of axially aligned recesses formed in the external surface of said intermediate portion and a plurality of elongated apertures formed in at least some of said recesses with the longitudinal axes of said apertures aligned with the longitudinal axes of said recesses, said apertures extending through said sheath to expose portions of said core, the elongated side edges of said recesses and apertures forming respective leading and trailing edges in the direction of oscillatory vibration and said apertures and recesses being configured such that said trailing side edges stand proud to present upstanding wall portions facing in said direction of oscillatory vibration.

33. A vibrator as claimed in claim 32, wherein the leading edges of said apertures are cut away to merge into the external surface of the vibrator.

34. A vibrator as claimed in claim 33, wherein the cut away leading edges of the apertures merge with the external surface of the vibrator at a chord angle.

35. A vibrator as claimed in claim 33, wherein elongated recesses are formed lengthwise in at least one of said frusto-conical leading and trailing end portions.

36. A vibrator as claimed in claim 35, wherein elongated recesses are formed lengthwise in both said leading and trailing end portions.

37. A vibrator as claimed in claim 35, wherein the elongated recesses in at least one of said leading and trailing end portions are tear-shaped and wherein the forward side edge of each tear-shaped recess in the direction of vibration is cut back to merge with the frusto-conical body portion to expose the opposed rearward side edge which thereby presents an upstanding wall portion facing in the direction of vibration.

* * * * *

UNITED STATES PATENT AND TRADEMARK OFFICE

CERTIFICATE OF CORRECTION

PATENT NO. : 6,811,297 B2
DATED : November 2, 2004
INVENTOR(S) : Fred Oswald

It is certified that error appears in the above-identified patent and that said Letters Patent is hereby corrected as shown below:

Title page,
Item [*] Notice, "149" should read -- 166 --.

Signed and Sealed this

Twenty-ninth Day of March, 2005

JON W. DUDAS
*Director of the United States Patent and Trademark Office*